United States Patent [19]

Kundin

[11] 4,285,093

[45] Aug. 25, 1981

[54] CARPET HOLDER BASEBOARD

[76] Inventor: Jane I. Kundin, 1288 Laurel Hill Dr., San Mateo, Calif. 94402

[21] Appl. No.: 21,849

[22] Filed: Mar. 19, 1979

[51] Int. Cl.[3] ..... A47G 27/04

[52] U.S. Cl. ..... 16/17

[58] Field of Search ..... 16/4–17, 16/DIG. 13; 52/273; 24/67.1; 211/45, 47, 48, 89; 248/316 B

[56] References Cited

U.S. PATENT DOCUMENTS

| | | | |
|---|---|---|---|
| 143,784 | 10/1873 | Kested | 16/16 |
| 358,049 | 2/1887 | McCastune | 16/7 |
| 3,221,892 | 12/1965 | Morcheles et al. | 211/48 |

FOREIGN PATENT DOCUMENTS

| | | | |
|---|---|---|---|
| 187802 | 7/1907 | Fed. Rep. of Germany | 16/17 |

*Primary Examiner*—Doris L. Troutman

*Attorney, Agent, or Firm*—Limbach, Limbach & Sutton

[57] ABSTRACT

An apparatus for securing a piece of fabric, such as carpet or other floor coverings, along a floor area, or for securing fabric along walls, windows or other areas of a room, having a fixed baseboard type portion attached to the baseboard region of the wall nearest the floor over which the carpet is to be laid, and a freely detachable arm, designed to be removable from the fixed member. The fabric to be fastened with the apparatus is extended between the fixed member and the freely detachable member with means between the two sections for holding the fabric in place. In one embodiment of the apparatus, the fixed member is connected to the freely detachable member by means of a ball-and-socket joint.

6 Claims, 4 Drawing Figures

CARPET HOLDER BASEBOARD

FIELD OF THE INVENTION

The invention relates to a fabric fastener and more particularly it relates to an apparatus for securing carpets over a floor area, without resulting in any damage at all to the floors, particularly hardwood floors, and for allowing for the easy removal of floor coverings or other fabrics for cleaning or redecorating purposes.

BACKGROUND OF THE INVENTION

The problem of securely affixing carpets and other floor coverings to floors and wall coverings such as draperies to walls without damaging the floors and the walls as the case may be, has been a long existing one. The most widespread means known and used in the art for laying carpets today is the use of a carpet nailing or tack strip which is nailed to the floor with several tacks driven through the strip to be exposed about the top surface of the strip when the strip is securely attached to the floor. This strip has the effect of permanently affixing the carpet or other floor covering to the floor. Even where the carpet is removed the removal process is not an easy one and the result is usually a damaged floor which has to be replaced or covered by other coverings. Also with use of this carpet nailing or tack strip, the carpet or other floor covering cannot be easily removed for cleaning and replaced routinely by one doing housework on a day-to-day basis. This routine removal of certain carpets occurs particularly in a bathroom or kitchen where the carpets or other floor coverings in these areas are quite apt to become soiled and require frequent cleanings. Usually when carpets are placed in areas such as the bathrooms or kitchens, such floor coverings are put down in a manner that they can be easily removed. As a result the carpets or other floor coverings in these areas are not securely attached to the floor and as such there is a constant effort made to keep the floor covering straightened our in certain areas along the walls of bathroom or kitchen areas by placing certain large objects at various strategic points around the room to provide a means of keeping the carpets affixed to the floors in a straightened out position.

There have been various carpet fasteners, other than the carpet nailing strip, which have been designed to securely affix carpeting or other floor coverings to floors; but these fastening devices have often resulted in large protrusion from the wall, to which the device is affixed, and into the living area of the room. An example of such a fastener is disclosed and taught by U.S. Pat. No. 317,824 issued to McFadden et al (now expired). In that reference a carpet fastener was claimed which had two sections which were attached to each other with nails or screws and which had the carpet or other floor covering extended between the two sections with the screws or nails also extending through the carpet. The lower section A of the McFadden fastener has a section of the carpet wrapped around it before the carpet comes into contact with the securing nails or screws. Once the carpeting has been wrapped around the section A of the fastener, the two sections are fastened by means of the screws or nails and the entire fastening device is attached to the floor by means of nails or other screws. By wrapping the carpeting around the section A of the McFadden device, a larger amount of carpeting is needed to allow for this wrapping than is usually needed to cover a floor using the tack strip or the fastener taught herein. As illustrated in the McFadden reference, particularly FIG. 1, the McFadden fastener takes up quite a bit of room in protruding from the wall and extending several inches or maybe even one foot into the living area of the room. As stated the McFadden fastener is permanently attached to the floor of the room, resulting in damage to the floor areas as is the case with the present day carpet nailing strips. This means of attachment necessarily limits the possibilities for decorating and redecorating a room with floor coverings, since whenever a carpet is removed from the floor new floor coverings must be put down to cover the damaged area of floor where the fastening device has been affixed. While the McFadden fastener as illustrated in FIGS. 4 and 5 may be attached to the wall of the room, it is clear that where the fastener is so attached, there will still be a large protrusion from the wall into the living area. Further, it is not clear as to how secure the fastener and carpet will be in the area of a′ and B′ (FIG. 4). It appears that a filler of some sort will be required between the area a′ and the floor to allow the fastener and the carpet to lie level in this area. Even with the McFadden fastener being attached to the wall the carpet fastener must either always be in use to secure carpets or if not in use for that purpose, both sections of the apparatus would need to be connected to each other and secured to the floor or wall, resulting in the above described protrusion from the wall regardless of whether the apparatus is in use or not. This is the case because there have been no provisions made in the McFadden apparatus for displaying a decorative carpet fastener, in and of itself even when the fastener is not in use for securing carpets or other floor coverings.

SUMMARY OF THE INVENTION

Even with the McFadden fastener and with the present day carpet nailing strip, there is still a need in the art for a fastening device for use in laying carpets or other floor or wall covering which when used takes up a minimum amount of space and does not protrude unnecessarily into the living area of a room, and also allows for easy application, easy removals and unlimited possibilities for redecoration. An apparatus which does not cause any damage to the floors, particularly hardwood floors which one may desire to exhibit from time to time without any coverings at all, is particularly desirable and needed in the art. Such an apparatus is desired which, even when not in use, can stand alone in a room and be decorative in and of itself. It is further desirable to have an apparatus which can be versatile for use in laying carpets, wall hangings, window coverings, or even in some instances to double-pane windows.

In view of the still existing problems with the known means of covering floors and walls, applicant has invented a fastening apparatus, primarily for use in scrubbing floor or wall coverings, but which has additional and unlimited uses, which is a two part baseboard design with one part of the baseboard being permanently affixed to a wall, for example, along the baseboard section of the room, and with the other part of the apparatus being a freely detachable arm which can be mounted about the top portion of the fixed baseboard region when the apparatus is used to secure floor or wall coverings. When the apparatus is not in use for such purposes the detachable arm may be either affixed to or detached from the fixed section, in either instance providing for a decorative fixture in the room. Applicant's invention is designed to take up a minimum amount of living area space in a room where it is used.

BRIEF DESCRIPTION OF THE DRAWINGS

The above discussed advantages and other characteristic features of the subject invention will be in part apparent from the accompanying drawings, and in part pointed out in the following detailed description of the invention in which reference will be made to the accompanying drawings wherein like reference numerals designate corresponding parts, and wherein.

DETAILED DESCRIPTION OF THE PREFERRED EMBODIMENTS

Figure 1A:
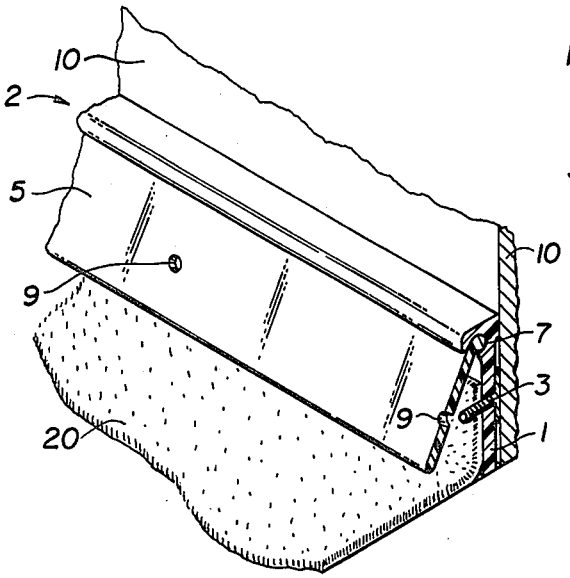
FIG. 1*a* is a front perspective view of one embodiment of the fabric fastener of the present invention illustrating the apparatus in its open position.
Figure 1B:
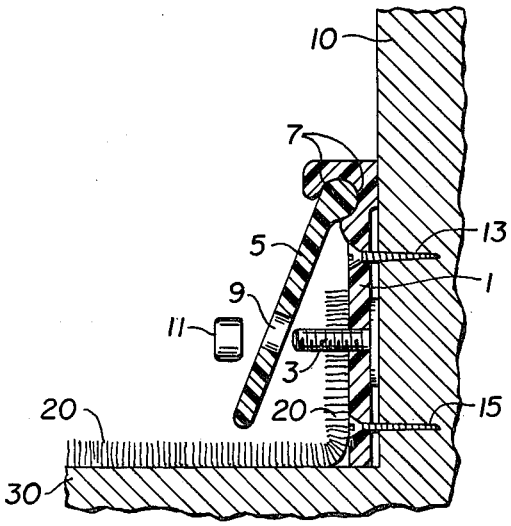
FIG. 1*b* is a cross section, side elevational view of the FIG. 1*a* apparatus.

Referring to the figures, FIG. 1*a* illustrates one embodiment of the invention in which the fabric fastener 2 is used to secure a piece of carpeting 20 about the area of a floor 30 of a room where the fastener 2 is attached along a portion of wall 10. Fastener 2 is illustrated to have a fixed baseboard section 1 attached to wall 10 by means of screws 13 and 15 (see FIGS. 1*b* and 2*b*). Fastener 2 is further illustrated to have a movable arm section 5 which is hingedly attached to the fixed portion 1 by means of a ball-and-socket joint 7. Movable arm 5 further has orifices 9 located along its surface which are designed to receive screws 3, such as a carpet screw, to be received by a screw cap 11 to affix arm 5 in a longitudinal position relative to fixed baseboard 1 (see FIGS. 2*a* and 2*b*). Screws 3 are extended through fixed baseboard 1 in the direction of arm 5. A portion of carpet 20 extends between movable arm 5 and fixed baseboard portion 1 of fastener 2 with carpet screws 3 extending through the nap of carpet 20 prior to passing through orifices 9 to be received by screw caps 11. As illustrated, fastener 2 is attached to the wall 10 of a room so as not to damage any part of floor 30. It is clearly illustrated in all figures above that the fastener 2 is at no point attached to the floor 30.

Figure 2A:
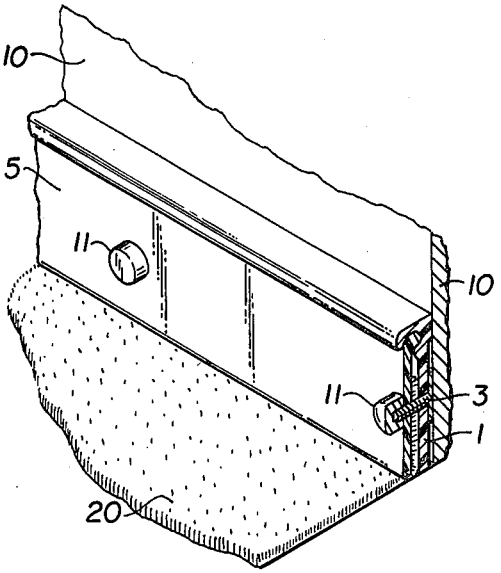
FIG. 2*a* is a front perspective view of one embodiment of the fabric fastener of the present invention illustrating the apparatus in the closed position; and, FIG. 2*b* is a cross section, side elevational view of the FIG. 2*a* apparatus.
Figure 2B:
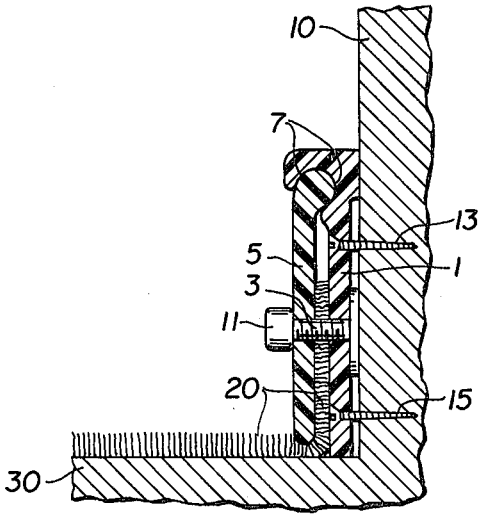

FIGS. 2*a* and 2*b* clearly illustrate the minimum amount of protrusion which fastener 2 has into the living area of the room whether the fastener is in use or not.

When fastener 2 is not in use to secure a carpet or other floor covering over floor 30, removable arm 5 may be completely detached from the fixed baseboard section of the fastener or the arm 5 may be secured in position as in FIGS. 2*a* and 2*b* without any carpeting or other covering extending between the two sections of fastener 2. By arm 5 being completely removable from fixed section 1, a different arm 5 may be attached to a fixed section 1, thereby allowing for unlimited decoration possibilities. That is, a different color etc. arm 5 may be easily affixed to a fixed section 1 to allow for easy redecorating of the floor covering. Also, it is to be noted that arm 5 may be completely detached from fixed portion 1, allowing for frequent removal of the carpet for cleaning or redecorating purposes. Such a fastener is particularly useful for securing carpets in bathrooms or kitchens where such carpets frequently become soiled and require frequent washings.

In the above illustrated figures, fastener 2 is made out of wood or a wood-like material, however, the fastener may be constructed out of any durable material which has the strength capabilities for the different uses intended for the fastener. Fastener 2 may therefore be constructed out of certain plastics such as polyvinyl chloride (PVC) or certain other synthetic materials.

The fastener 2 has uses other than along the baseboard section of a room for securing carpets about the floor area. For example, the fastener 2 may be used along the interior wall section of a room for securing other wall coverings such as pictures or murals about a wall. Also, the fastener may be useful for hanging window coverings such as draperies. In this embodiment an additional runner attachment may be incorporated with the fastener 2 for holding the draperies. In all applications the fastener continues to have its unlimited possibilities for easy removal and for taking up a minimum amount of space around its area of application. The fastener may be installed in a similar manner about the ceilings of bedrooms for securing canopies over a bed.

In all possible embodiments of the fastener 2, it is to be noted that the fastener, when in operation, extends for only about $\frac{3}{4}''$ to 1" from the wall to which it is attached. This measurement may, however, vary depending on the milling process and the possible need to strengthen the hinge section 7 of the fastener by increasing its width. In the illustrated embodiments of the invention the fixed baseboard section measures about 3" to 4" high from the floor 30.

It must further be noted that when fastener 2 is not in use to secure a floor covering about floor 30, that the floor 30 will be left undamaged for still additional decorating possibilities. This feature of fastener 2 is particularly desirable with hardwood floors, where one may frequently wish to exhibit such floors free of any floor coverings.

Other uses for fastener 2 include double paning windows where a piece of Plexiglas or other material is extended between removable arm 5 and fixed portion 1, in order to reduce heat loss from windows. A further use for fastener 2 may be to hold draperies about windows.

While the invention has been described in detail with particular reference to certain embodiments thereof, as where the fastener disclosed is used for securing floor coverings, it will be understood that certain variations and modifications of the invention can be effected within the spirit and scope of the invention, and that the invention is thus limited only by the appended claims.

What is claimed is:

1. A fabric fastener for securing a piece of fabric about an area of a room comprising:

a fixed support member to be attached to an area of the wall;

a freely detachable arm hingedly connected to the upper portion of said fixed support member;

means extending outwardly through the surface of said fixed support member for securely connecting said freely detachable arm of said fastener to said fixed support member to securely position said detachable arm longitudinally adjacent the front surface of said fixed support member

2. A fabric fastener of the type recited in claim 1 wherein said freely detachable arm is hingedly connected to said fixed support means by a ball-and-socket joint.

3. A fastener of the type recited in claim 1 wherein said freely detachable arm has an orifice about its surface and wherein said fixed support member has a carpet screw extended through its surface such that said freely detachable arm is secured longitudinally adjacent said fixed support member when said carpet screw of said fixed support member is extended through the orifice in said freely detachable arm with a screw cap receiving said carpet screw once said carpet screw is extended through said freely detachable arm orifices.

4. A fabric fastener as recited in claim 3 wherein said fastener is used to secure a piece of carpet on the floor of a room along the wall of the room with a portion of the carpet extended between said fixed support member of said fastener and said freely detachable arm of said fastener and with said carpet screw extending through the nap of said carpet prior to being extended through the orifice of said freely detachable arm and received by said screw cap.

5. A fabric fastener as recited in claim 1 wherein said support member and said freely detachable arm are each constructed out of a durable material capable of long wear.

6. A fabric fastener as recited in claim 5 wherein said durable material is wood and said support member and said freely detachable arm are each decoratively designed.

* * * * *